US006662600B1

(12) United States Patent
Field et al.

(10) Patent No.: US 6,662,600 B1
(45) Date of Patent: Dec. 16, 2003

(54) FOAMED CLEANING LIQUID DISPENSING SYSTEM

(75) Inventors: Bruce F. Field, Golden Valley, MN (US); Joseph K. Krueger, Hopkins, MN (US); Bryan L. Christensen, Dayton, MN (US)

(73) Assignee: Tennant Company, Minneapolis, MN (US)

( * ) Notice: Subject to any disclaimer, the term of this patent is extended or adjusted under 35 U.S.C. 154(b) by 0 days.

(21) Appl. No.: 10/213,849

(22) Filed: Aug. 7, 2002

(51) Int. Cl.[7] ..... D06F 39/02

(52) U.S. Cl. ..... 68/17 R; 68/207; 134/102.1; 134/102.2

(58) Field of Search ..... 68/17 R, 207; 8/158; 134/100.1, 102.1, 102.2; 222/129; 261/19, 24, 29, 72.1

(56) References Cited

U.S. PATENT DOCUMENTS

| | | | | |
|---|---|---|---|---|
| 2,023,013 | A | * 12/1935 | Faber et al. | |
| 2,563,151 | A | * 8/1951 | Bjorksten | |
| 2,731,659 | A | 1/1956 | Coplen | 15/320 |
| 2,993,494 | A | * 7/1961 | Svensson | |
| 3,037,887 | A | * 6/1962 | Brenner et al. | |
| 3,078,190 | A | * 2/1963 | Balser et al. | |
| 3,162,427 | A | * 12/1964 | Knudon et al. | |
| 3,212,762 | A | 10/1965 | Carroll et al. | 261/124 |
| 3,231,134 | A | * 1/1966 | Webster | |
| 3,392,418 | A | 7/1968 | Schowalter | 15/320 |
| 3,436,262 | A | * 4/1969 | Crowe | |
| 3,453,678 | A | 7/1969 | Gehman et al. | 15/50 |
| 3,490,948 | A | * 1/1970 | Fairson | |
| 3,535,162 | A | * 10/1970 | Bray et al. | |
| 3,549,420 | A | * 12/1970 | Cunnningham | |
| 3,655,096 | A | 4/1972 | Easter | 222/82 |
| 3,676,889 | A | 7/1972 | Edlin | 15/320 |
| 3,761,987 | A | 10/1973 | Nayfa et al. | 15/50 |

(List continued on next page.)

FOREIGN PATENT DOCUMENTS

| | | | |
|---|---|---|---|
| DE | 3630555 | * | 3/1988 |
| DE | 44 13 783 A | | 3/1995 |
| EP | 0 744 148 A2 | | 11/1996 |
| EP | 1 044 645 A2 | | 10/2000 |
| JP | 59-144487 | * | 8/1984 |
| JP | 11216092 | | 8/1999 |
| WO | WO 95/09557 | | 4/1995 |
| WO | WO 00/35333 | | 6/2000 |
| WO | WO 02/05047 | | 1/2002 |
| WO | WO 02/06435 | | 1/2002 |

OTHER PUBLICATIONS

International Search Report from International Application No. PCT/US 02/19367, filed Jun. 17, 2002, dated Dec. 12, 2002.

International Search Report from International Application No. PCT/US 02/23758 filed Jul. 26, 2002 (date of report Nov. 14, 2002).

International Search Report from International Application No. PCT/ US 02/23769 filed Jul. 26, 2002 (date of report Dec. 2, 2002).

Discover Magazine, Jun. 2002, "Does the Universe Exist if We Don't Observe It?", including cover; Table of Contents, and pages 26 and 27.

*Primary Examiner*—Frankie L. Stinson
(74) *Attorney, Agent, or Firm*—Westman, Champlin & Kelly

(57) ABSTRACT

A foamed cleaning liquid dispensing system for use in a washing machine includes a cleaning liquid dispenser and a foaming device. The cleaning liquid dispenser includes an output flow of cleaning liquid, which is received by the foaming device. The foaming device includes an input flow of air and a mixing member, in which the flows of air and the cleaning liquid are combined to form an output flow of foamed cleaning liquid that is directed to a washing chamber of the washing machine.

16 Claims, 9 Drawing Sheets

U.S. PATENT DOCUMENTS 3,774,262 A 11/1973 Anthony et al. ..... 15/322
3,789,449 A 2/1974 MacFarland et al. ..... 15/4
3,823,727 A * 7/1974 Fry
3,931,662 A 1/1976 Nayfa et al. ..... 15/320
3,940,826 A 3/1976 Phillips et al. ..... 15/320
4,000,536 A 1/1977 Nayfa et al. ..... 15/50
4,061,001 A 12/1977 von der Eltz et al. ..... 68/200
4,107,075 A 8/1978 Kramer ..... 252/359
4,133,773 A * 1/1979 Simmons
4,167,798 A 9/1979 Kltigl et al. ..... 15/320
4,167,799 A 9/1979 Webb ..... 15/320
4,191,590 A 3/1980 Sundheim ..... 134/21
4,369,544 A 1/1983 Parisi ..... 15/320
4,419,141 A * 12/1983 Kunkel
4,429,432 A 2/1984 Copeland et al. ..... 15/320
4,511,486 A * 4/1985 Sha
4,570,856 A 2/1986 Groth et al. ..... 239/310
4,595,420 A 6/1986 Williams, III et al. ..... 134/6
4,667,364 A 5/1987 Meili ..... 15/320
4,676,287 A 6/1987 Fitzwater ..... 141/285
4,780,243 A 10/1988 Edgley et al. ..... 252/307
4,849,027 A * 7/1989 Simmons
4,875,607 A 10/1989 Torita et al. ..... 222/643
4,881,288 A 11/1989 May et al. ..... 15/98
4,932,227 A 6/1990 Hogrefe ..... 68/17
4,974,618 A 12/1990 Nysted ..... 134/21
5,031,837 A 7/1991 Hanish ..... 239/267
5,060,342 A 10/1991 Brazier ..... 15/322
5,133,107 A 7/1992 MacDonald ..... 15/50.3
5,195,338 A 3/1993 Russo ..... 68/12.18
5,213,120 A * 5/1993 Dickson
5,295,373 A 3/1994 Lim et al. ..... 68/12.05
5,307,649 A 5/1994 Lim et al. ..... 68/12.05
5,462,607 A * 10/1995 Mestetsky et al.
5,509,972 A * 4/1996 Akazawa et al.
5,590,551 A 1/1997 Hong ..... 68/183
5,649,643 A 7/1997 Ridgeway ..... 222/105
5,653,129 A 8/1997 Jang ..... 68/13
5,687,440 A 11/1997 Min et al. ..... 8/158
5,687,590 A 11/1997 Borroni et al. ..... 68/17
5,758,521 A 6/1998 Roberts ..... 68/17
5,765,997 A 6/1998 You ..... 417/312
5,770,118 A 6/1998 Lee ..... 261/30
5,782,109 A 7/1998 Spriggs et al. ..... 68/17
5,813,086 A 9/1998 Ueno et al. ..... 15/320
5,826,749 A 10/1998 Howland et al. ..... 222/1
5,853,814 A 12/1998 Murphy ..... 239/304
6,085,556 A 7/2000 Moon ..... 68/13
6,090,217 A * 7/2000 Kittle
6,094,948 A 8/2000 Hong et al. ..... 68/183
6,170,303 B1 1/2001 Hong et al. ..... 68/183
6,209,756 B1 4/2001 Van Der Heijden ..... 222/105
6,276,613 B1 8/2001 Kramer ..... 239/304
6,349,440 B1 2/2002 Amberg et al. ..... 8/158
6,418,586 B2 7/2002 Fulghum ..... 15/320

* cited by examiner

FOAMED CLEANING LIQUID DISPENSING SYSTEM

CROSS REFERENCE TO RELATED APPLICATIONS

Reference is hereby made to the following related applications: U.S. application Ser. No. 10/026,411, filed Dec. 21, 2001, still pending, and entitled "APPARATUS AND METHOD OF USE FOR CLEANING A HARD FLOOR SURFACE UTILIZING AN AERATED CLEANING LIQUID", which in turn claims priority to U.S. Provisional Application Ser. No. 60/308,773, filed Jul. 30, 2001, still pending, and entitled "APPARATUS AND METHOD OF USE FOR CLEANING A HARD FLOOR SURFACE UTILIZING AN AERATED CLEANING LIQUID"; U.S. application Ser. No. 10/143,582, filed May 9, 2002, still pending, and entitled "CLEANING LIQUID DISPENSING SYSTEM FOR A HARD FLOOR SURFACE CLEANER"; U.S. application Ser. No. 10/152,537, filed May 21, 2002, still pending, and entitled "CHEMICAL DISPENSER FOR A HARD FLOOR SURFACE CLEANER"; and U.S. application Ser. No. 10/152,549, filed May 21, 2002 still pending, and entitled "CLEANER CARTRIDGE." All of the above-referenced applications are incorporated herein by reference in their entirety.

FIELD OF THE INVENTION

The present invention generally relates to washing machines and, more particularly, to a foamed cleaning solution dispensing system for use in washing machines.

BACKGROUND OF THE INVENTION

There are generally two categories of washing machines that are used for the purpose of washing laundry articles such as clothes. A first category is a vertical axis washing machine that allows for top-loading of laundry articles into a washing chamber that includes an agitator that rotates about a vertical axis. The agitator generates a vortex flow within the washing chamber and causes the laundry articles to undergo a vigorous frictional movement against each other and the agitator to provide the desired cleaning action. A second category of laundry machine is a horizontal axis laundry machine that allows for front-loading of laundry articles into the washing chamber and includes a rotary drum that rotates about a horizontal axis and is partially submerged in the cleaning liquid of the washing chamber. With this type of washing machine, the laundry articles contained in the rotary drum are rubbed against each other as the drum rotates.

The above-described washing machines typically include a detergent container that is adapted to contain a quantity of powder or liquid detergent product that when mixed with water forms the cleaning liquid that is used to wash the laundry articles. The detergent container is in fluid communication with the washing chamber of the washing machine. A flow of water is sent through the detergent container during the wash cycle of a selected washing sequence to thereby flush out and convey into the washing chamber a quantity of the detergent that further mixes with water in the washing chamber to form the cleaning liquid. Different detergent products and/or fabric softeners can be added to the detergent container at different phases or cycles of an ongoing washing sequence to have them introduced into the washing chamber.

It has been estimated that 35 billion loads of laundry are washed in the United States each year. As a result, an enormous amount of energy is consumed by washing machines to clean laundry. Additionally, pollutants in the form of detergents and chemical agents that are used during the washing of the laundry can potentially harm the environment. Accordingly, concerns exist not only to the enormous amount of energy that is consumed by washing machines, but the potential harm that detergents and other chemicals used during the washing process may have on the environment.

The energy used by a washing machine to wash a load of laundry is directly related to the duration of the wash and rinse cycles. The duration of the rinse cycles are related to the amount of detergent or chemicals that are used. In general, the more detergent used during a wash cycle, the longer the rinse cycle must be in order to extract the detergent from the laundry articles and, hence, the more energy that must be used by the washing machine. Furthermore, the more detergent used during a wash cycle, the more pollutant byproducts that are generated. Accordingly, both the energy used by the washing machine and the pollutant byproducts produced thereby can be reduced by reducing the amount of detergent that is used during the wash cycle.

To that end, efforts are directed to increase the cleaning efficiency of washing machines to not only reduce the amount of energy that is used during wash and rinse cycles but, possibly, the amount of detergent that is used as well. One method of accomplishing this is through the introduction of air bubbles into the washing chamber during the wash cycle. The air bubbles are used to improve the cleaning efficiency of the cleaning liquid by attracting dirt particles to their surfaces. The air bubbles along with the clinging dirt particles are then removed from the washing chamber. Although air bubbles can be generated during the washing cycle as a result of the movement of the clothes within the washing liquid, more efficient cleaning can result through the injection of air bubbles into the washing chamber by a bubble generating component. Such bubble generating components are typically positioned at a base of the washing chamber and produce air bubbles that travel through the cleaning liquid that is stored therein.

There exists a never-ending demand for improvements to washing machines to increase their cleaning efficiency while reducing their energy consumption and their production of environmentally harmful byproducts.

SUMMARY OF THE INVENTION

The present invention is directed to a foamed cleaning liquid dispensing system for use in a washing machine that improves the cleaning efficiency of the cleaning liquid, reduces washing machine energy consumption and chemical waste. The foamed cleaning liquid dispensing system generally includes a cleaning liquid dispenser and a foaming device. The cleaning liquid dispenser includes an output flow of cleaning liquid, which is received by the foaming device. The foaming device includes an input flow of air and a mixing member in which the flows of air and cleaning liquid are combined to form an output flow of foamed cleaning liquid that is directed to a washing chamber of the washing machine. The foamed cleaning liquid provides a significant improvement to the cleaning efficiencies of the cleaning liquid, which allows for less cleaning agent or chemical to be used for a given wash cycle. As a result, the foamed cleaning liquid dispersing system of the present invention reduces washing machine energy consumption and chemical waste.

These and other features and benefits that characterize embodiments of the present invention will be apparent upon reading the following detailed description and review of the associated drawings.

DETAILED DESCRIPTION OF THE PREFERRED EMBODIMENTS

Figure 1:
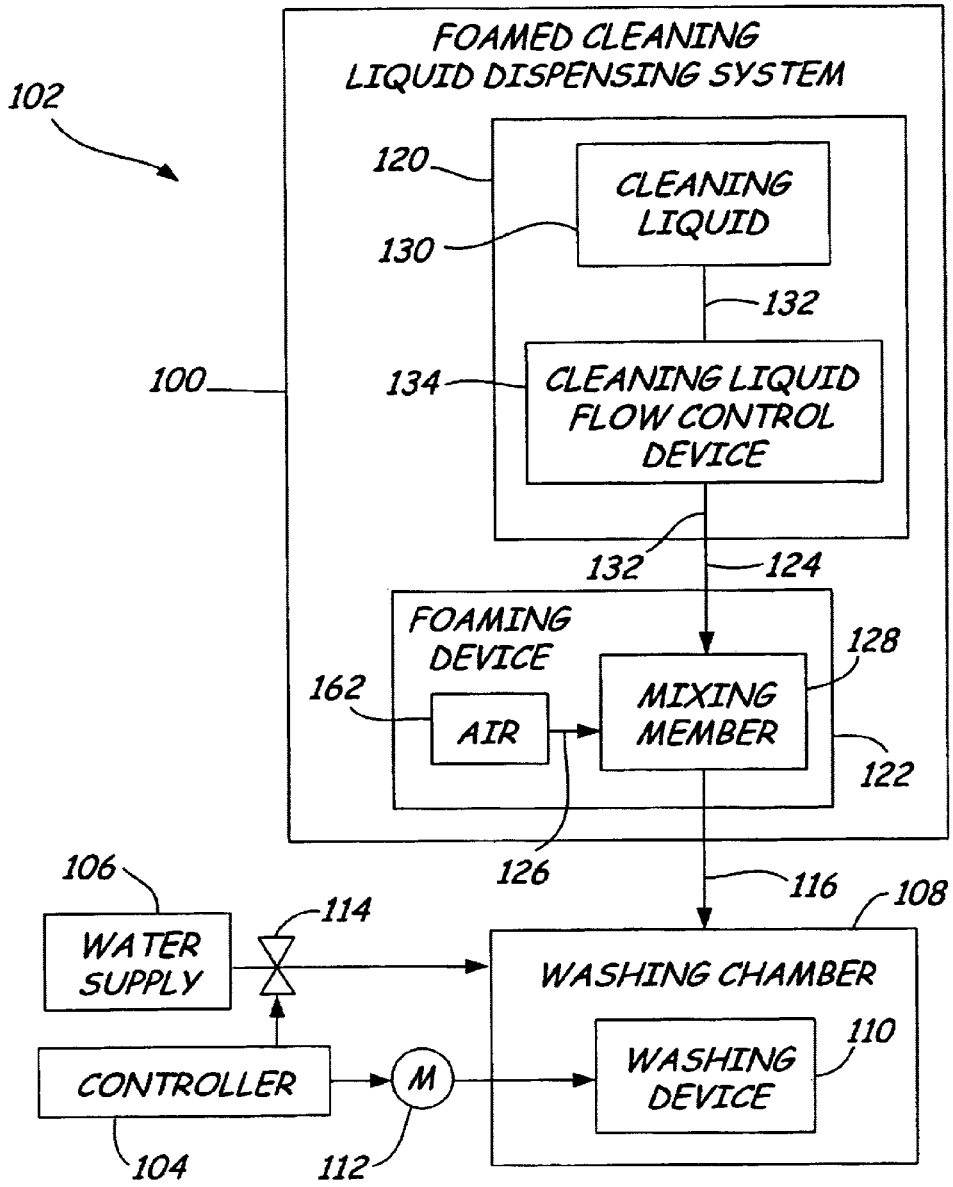
FIG. 1 is a schematic diagram of a washing machine that includes a foamed cleaning liquid dispensing system in accordance with various embodiments of the invention.

The present invention is directed to a foamed cleaning liquid dispensing system 100 for use in a washing machine, such as washing machine 102 as shown in the schematic diagram of FIG. 1. System 100 is generally adapted to dispense a foamed cleaning liquid for use during wash cycles to clean laundry articles. The foamed cleaning liquid produced by system 100 enhances the cleaning process performed by the washing machine as compared to the prior art through better activation of the surfactant (surface-active material) of the cleaning liquid so that it works more quickly and efficiently by forming stable, or quasi-stable, dispersions with soils so that they are readily removed from the laundry articles. The foaming of the cleaning liquid not only allows for less cleaning agent to be used, but also allows for complete dispersion of the cleaning agent into the water at low temperatures. This provides advantages over the prior art, which typically requires the water to be heated in order to ensure that the cleaning agent properly goes into the solution to form the cleaning liquid. As a result, energy is conserved by foamed cleaning liquid dispensing system 100 of the present invention by not only allowing for shorter rinse cycles due the use of less cleaning agent, but also by allowing the wash cycle to be performed at lower temperatures. Thus, washing machine 102 utilizing system 100 can perform cleaning operations with less chemicals for improved cleaning efficiency, lower energy consumption, and less chemical waste, than would be possible using conventional washing machine cleaning liquid dispensing systems.

In addition to foamed cleaning liquid dispensing system 100, washing machine 102 also includes several conventional components, such as a controller 104, a supply of water 106, a washing chamber 108, a washing device 110 contained in washing chamber 108, and a motor 112 that drives washing device 110. Controller 104 controls the operation of washing machine 102 including motor 112 and other components of washing machine 102, such as water flow control valve 114, to perform various washing cycles to clean laundry articles that are contained within washing chamber 108. Washing machine 102 can also include sensors (not shown), such as temperature and water level sensors, that controller 104 can use during washing operations.

Washing machine 102 can be any type of washing machine including a vertical axis washing machine or a horizontal axis washing machine. The vertical axis washing machine allows for top-loading of laundry articles into washing chamber 108 and includes washing device 110 in the form of an agitator. The agitator is driven by motor 112 to generate a vortex flow within washing chamber 108 that causes the laundry articles to undergo a vigorous frictional movement against each other and the agitator to provide the desired cleaning action. The horizontal axis laundry machine that allows for front-loading of laundry articles into washing chamber 108. In accordance with this type of laundry machine, washing device 110 is typically a rotary drum that rotates about a horizontal axis and is partially submerged in the cleaning solution that is contained in washing chamber 108. With this type of washing machine, the laundry articles contained in the rotary drum are rubbed against each other as the rotary drum rotates.

An example of a typical wash sequence includes a wash cycle followed by one or more rinse cycles. After loading the laundry articles into washing chamber 108, the wash cycle begins by adding hot, warm or cold water to washing chamber 108 from water supply 106 by actuation of valve 114 by controller 104. Additionally, as will be discussed in greater detail below, controller 104 or a separate controller controls the operation of foamed cleaning liquid dispensing system 100 to dispense a predetermined quantity of foamed cleaning liquid into washing chamber 108, as indicated by arrow 116. Next, controller 104 causes motor 112 to drive washing device 108 and commence the washing of articles contained in washing chamber 108. The washing cycle ends after a predetermined period of time, and one or more rinse cycles are performed after washing chamber 108 is drained. Each rinse cycle begins by adding hot, warm or cold water from supply 106 to washing chamber 108. Additionally, a rinse agent or fabric softener can be added by foamed cleaning liquid dispensing system 100 in accordance with one embodiment of the invention. During the rinse cycle, washing device 110 is again driven by motor 112 to agitate the laundry articles within the water. Finally, the soiled water is typically extracted from the laundry articles by rotating the laundry articles within washing chamber 108 and draining the extracted liquid to waste.

Foamed cleaning liquid dispensing system 100 generally includes a cleaning liquid dispenser 120 and a foaming device 122. Cleaning liquid dispenser 120 includes an output flow of cleaning liquid 124 that is received by foaming device 122. Foaming device 122 includes an input flow of air 126 and a mixing member 128 that combines the cleaning liquid flow 124 with the air flow 126 to thereby generate the flow of foamed cleaning liquid 116 that is directed into washing chamber 108.

One embodiment of cleaning liquid dispenser 120 includes a supply of cleaning liquid 130, conduit 132, and a cleaning liquid flow control device 134. Conduit 132 is in fluid communication with cleaning liquid supply 130 and foaming device 122. Cleaning liquid flow control device 134 is positioned in line with conduit 132 and is adapted to control the output flow of cleaning liquid 124 which is provided to fluid mixing member 128.

Figure 2:
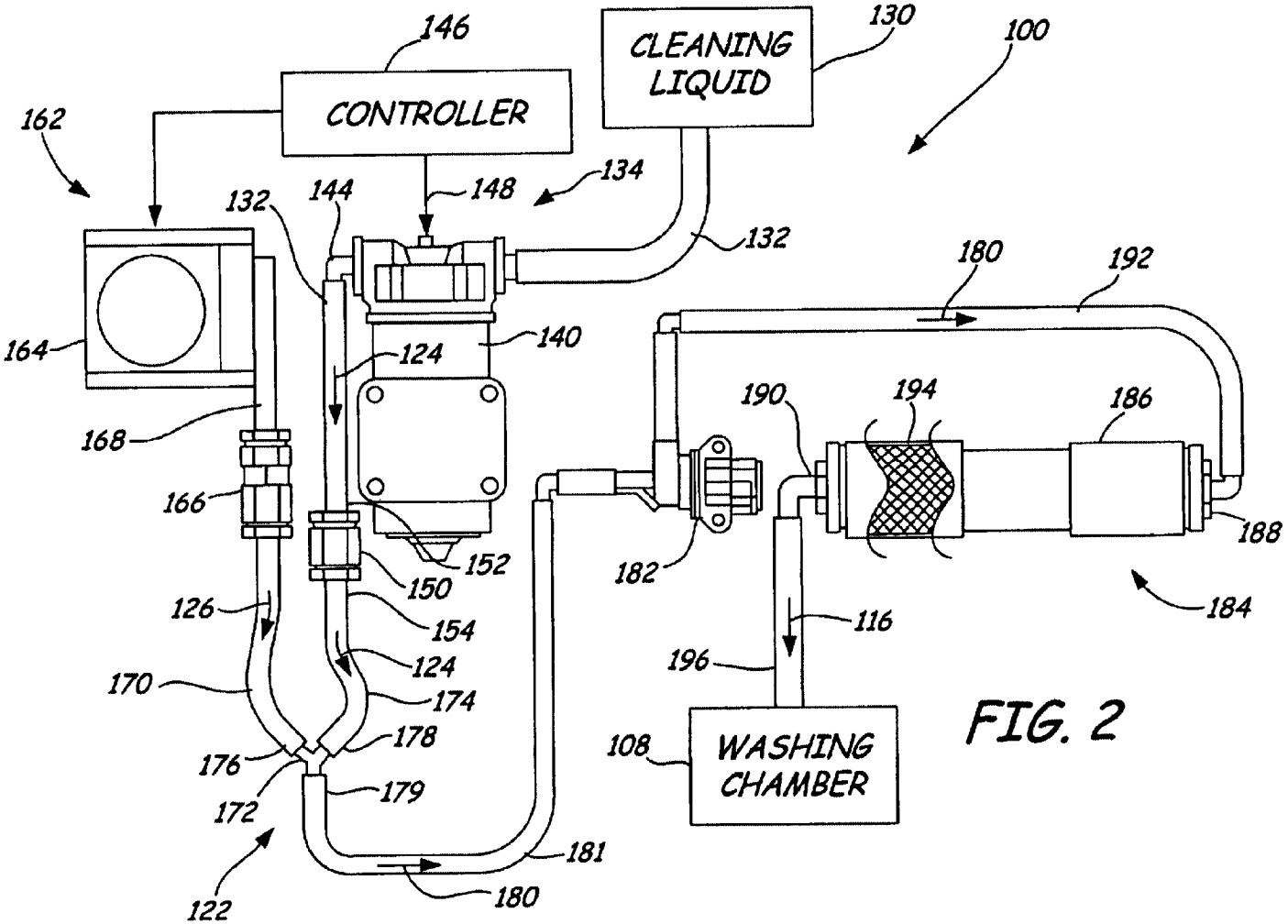
FIG. 2 is a simplified diagram of a foamed cleaning liquid dispensing system in accordance with various embodiments of the invention.

FIG. 2 is a simplified diagram of a foamed cleaning liquid dispensing system 100 including a cleaning liquid dispenser 120 and foaming device 122 in accordance with various embodiments of the invention. In accordance with one embodiment, cleaning liquid flow control device 134 includes a pump 140 in line with the conduit 132, which is fluidically coupled to the cleaning liquid supply 130. Pump 140 is adapted to drive the cleaning liquid flow 124 through conduit 132 in a controlled manner.

Pump 140 includes an outlet 144, through which cleaning liquid flow 124 is driven, that is maintained at a high pressure. In accordance with one embodiment, the pressure at outlet 144 is held substantially constant at approximately 40 pounds per square inch (psi). Pump 140 can be a diaphragm pump, such as diaphragm pump model number 8006-543-250 manufactured by Shur Flow of Garden Grove, Calif., or other suitable pump.

Cleaning liquid flow control device 134 can further include a controller 146 having a control signal 148 that is electrically coupled to pump 140, which drives output flow 124 of cleaning liquid in response to the control signal. Accordingly, control signal 148 can cause pump 140 to increase or decrease the pressure at output 144 to thereby increase or decrease the flow rate of output flow 124 of cleaning liquid, respectively. Pump 140 can be powered using conventional means or from control signal 148. Controller 146 can be either separate or integrated with controller 104 of washing machine 102, shown in FIG. 1.

In accordance with another embodiment of the invention, cleaning liquid flow control device 134 further includes a flow restriction member 150 in line with conduit 132 and pump 140. Flow restriction member 150 is configured to generate a pressure drop in conduit 132 to thereby restrict the flow rate of the cleaning liquid flow 124 therethrough. Accordingly, flow restriction member 150 includes an upstream high pressure side 152 and a downstream low pressure side 154. Multiple flow restriction members 150 can be employed to provide the desired pressure drop in conduit 132 that results in desired volume flow rate of cleaning liquid flow 124. In accordance with one embodiment, the output flow 124 of cleaning liquid is preferably limited by flow restriction member 150 to approximately 2.0 gallons per minute (GPM).

Figure 3:
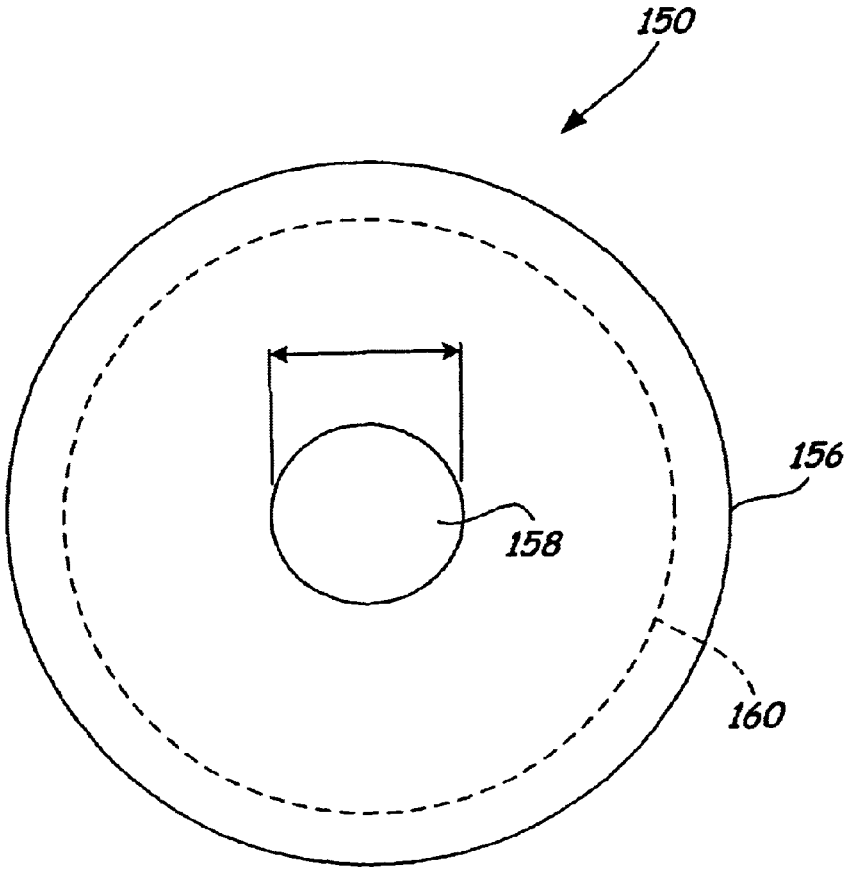
FIG. 3 is a schematic diagram of a flow restriction member in accordance with an embodiment of the invention.

In accordance with one embodiment, flow restriction member 150 is a metering orifice or orifice plate 156, shown in FIG. 3. Orifice plate 156 includes an orifice 158 and is installed in conduit 132, the inner diameter of which is indicated by dashed line 160, such that cleaning liquid flow 124 is forced to flow through orifice 158. This produces the pressure drop as described above and restricts the cleaning liquid flow 124 to the desired flow rate for a given pressure at outlet 144 of pump 140. In accordance with a preferred embodiment, orifice 158 of orifice plate 156 has a diameter D of approximately 0.3 inches to provide the desired output flow of 2.0 GPM when the pressure of outlet 144 of pump 140 is at 40 psi. One example of a suitable metering orifice or orifice plate 156 is part number CP 4916-40 manufactured by Spraying Systems Company of Wheaton, Ill. Other orifice plates or metering orifice configurations are possible as well, such as by providing multiple orifices in the plate 156 or other flow restriction configurations.

Foaming device 122 may include a variety of foam generation devices including, but not limited to, pressurized air and/or pressurized liquid systems, agitation systems, etc. In accordance with one embodiment, foaming device 122 includes an air system 162 that includes an air pump 164 that generates air flow 126, a check valve 166, and associated fluid conduit sections 168 and 170, as shown in FIG. 2. Suitable types of air pumps 164 include piston, diaphragm or rotary vane pumps. One preferred air pump 164 is a piston pump model number 22D1180-206-1002 manufactured by Gast Manufacturing, Inc. of Benton Harbor, Mich. Check valve 166 is provided to prevent the back flow of cleaning liquid into air pump 164. Check valves can also be positioned in line with cleaning liquid dispensing system 120 to prevent the back flow of fluid therethrough.

Mixing member 128 preferably includes a first mixing element 172 that receives air flow 126 from air system 162 via conduit section 170 and pressurized cleaning liquid from cleaning liquid dispensing system 120 via conduit section 174. First mixing element 172 is a Y-coupling having a pair of inlet, ports 176 and 178 and an outlet port 179. The cleaning liquid flow 124 and the air flow 126 are combined in first mixing element 172 to form a flow of aerated cleaning liquid 180, which is discharged through outlet port 179 into conduit section 181. First mixing element 172 can be alternatively configured, but should include at least a pair of inlet ports for receiving the cleaning liquid flow 124 and the air flow 126 and an outlet port for discharging the mixture. Furthermore, although first mixing element 172 is described as a passive mixing element, it may also include active mixing devices, such as an energized impeller.

In accordance with one embodiment, a valve 182 is provided in line with conduit section 181 to control the aerated cleaning liquid flow 180 therethrough. Valve .182 is preferably an electric solenoid valve, under control of controller 146, that is operable between an open position in which the aerated cleaning liquid flow 180 is permitted to flow through first mixing element 172, and a closed position in which the aerated cleaning liquid flow 180 is blocked. Alternative valves may be used to control the flow of fluid within the system 100, such as a variable output valve or other suitable component.

The aerated cleaning liquid flow 180 can be dispensed directly into washing chamber 108 as a form of foamed cleaning liquid flow 116 through, for example, a nozzle that can provide additional foaming action to increase the foam in flow 116. An example of such a nozzle will be discussed in greater detail below.

In accordance with another embodiment of the invention, fluid mixing member 128 further includes a foam generating member 184 that enhances the mixing of air and cleaning liquid and the generation of the foamed cleaning liquid 116. Foam generating member 184 can be a passive element including a rigid housing 186 having an inlet port 188 and an outlet port 190 as shown in FIG. 2. Inlet port 188 receives the aerated cleaning liquid flow 180 through conduit section 192. A diffusion medium 194 is contained in housing 186 and is adapted to increase foam generation by providing a shearing action, air entrainment, or a combination of both, to the aerated cleaning liquid flow 180. In accordance with a preferred embodiment, diffusion medium 194 includes a plurality of SCOTCH BRITE® brand copper pads, manufactured by Minnesota Mining and Manufacturing Company of St. Paul, Minn. Alternative diffusion media may also be practicable including, but not limited to, glass beads, foams, and other porous substrates.

The length and diameter of housing 186 of foaming member 184 as well as the structure of diffusion medium 194, are sized to maintain the operating pressure of system 100 at a desired level. For example, using a coarser diffusion medium 194 allows for easier passage of the aerated cleaning liquid flow 180 and the foamed cleaning liquid flow 116 through housing 186. However, such a coarser diffusion medium 194 also results in larger foam bubbles in the foamed cleaning liquid flow 116. However, by using a sufficiently long housing 186 with an appropriate diffusion medium 194, large foam bubbles formed near inlet 188 will break down into more desirable smaller micro-bubbles preferably of approximately 0.002 inches in diameter, prior to reaching outlet 190. As an example, housing 186 of the illustrated foaming member 184 is preferably approximately 9 inches long and has an inner diameter of approximately 2 inches.

The output flow of foamed cleaning liquid 116 is discharged from foaming member 184 at outlet port 190 and is directed toward washing chamber 108 via conduit section 196. Foaming member 184 may be provided at an incline relative to the ground surface so that inlet port 188 is at a slightly lower elevation than outlet port 190. This arrangement reduces the amount of foamed cleaning liquid 116 that is delivered to washing chamber 108 after valve 182 has been closed. Alternatively, valve 182 can be located downstream of outlet port 190 and closer to washing chamber 108 to provide further control over the amount of foamed cleaning liquid 116 that is dispensed into washing chamber 108.

Figure 4:
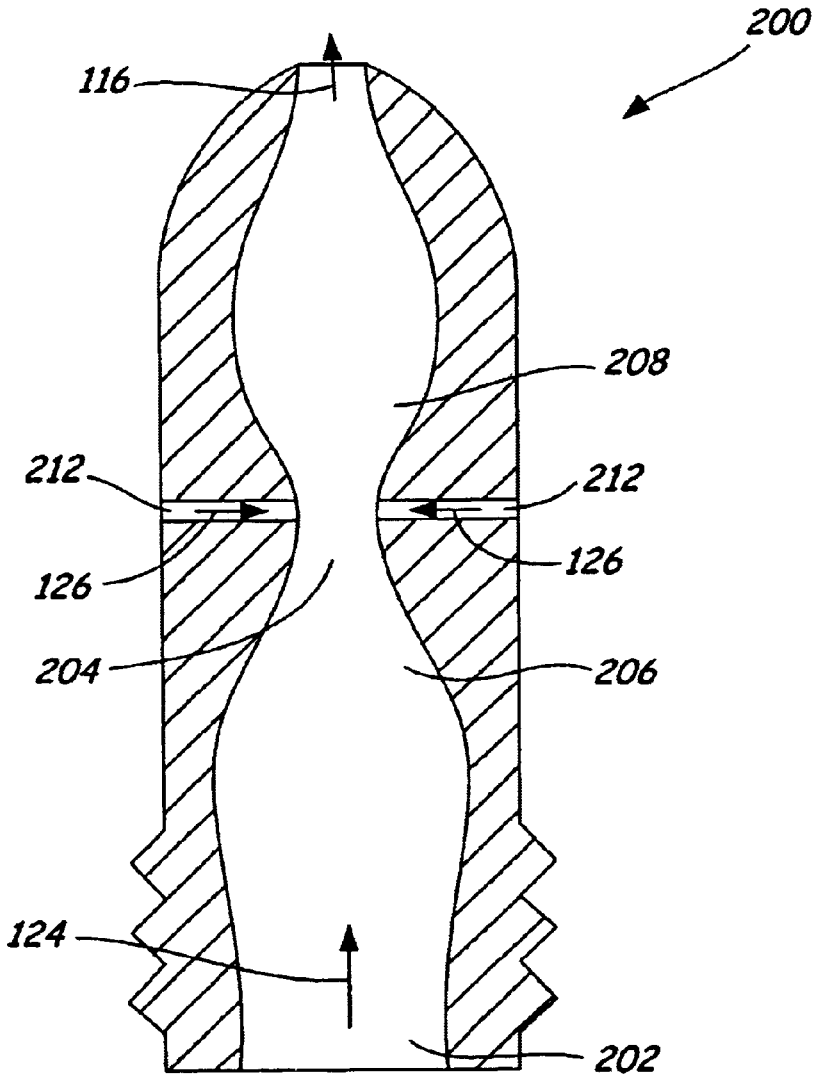
FIG. 4 is a simplified cross-sectional view of a nozzle that forms a foaming device in accordance with an embodiment of the invention.

FIG. 4 is a schematic diagram of another embodiment of foaming device 122. Here, foaming device 122 takes the form of a nozzle 200. Nozzle 200 includes an inlet 202 that receives the cleaning liquid flow 124 from cleaning liquid dispensing system 120. The flow 124 is directed through a constricted throat portion 204 having a convergent upstream end 206 and a divergent downstream end 208. Nozzle 200 also includes radial ports 212 extending from throat 204 through which air flow 126 is provided in response to the vacuum generated within throat 204 by the cleaning liquid flow 124. In accordance with this embodiment of foaming device 122, mixing member 128 generally corresponds to constricted throat portion 204 and mixing chamber 214 in which the aerated cleaning liquid is formed. The aerated cleaning liquid is finally dispensed as the foamed cleaning liquid flow 116 into washing chamber 108 through nozzle tip 210. One example of a suitable nozzle 200 is the Foam Cannon, part number HP 344030, distributed by Higher Power Supplies, Inc.

In operation, the triggering of a wash cycle by controller 104 of washing machine 102 causes controller 146 of system 100 to drive air pump 160 of air system 162 and pump 140 of cleaning liquid dispenser 120 for the embodiment depicted in FIG. 2. Additionally, if necessary, controller 146 opens valve 182. Pressurized air flow 126 is then directed through conduit section 168, check valve 166 and conduit section 170 to mixing element 172. Additionally, cleaning liquid dispensing system 120 delivers cleaning liquid flow 124 through pump 140, conduit section 132, flow restriction member 142 (if installed), and conduit section 174, to inlet port 178 of mixing element 172. The air flow 126 and cleaning liquid flow 124 are combined in mixing element 172 and discharged as aerated cleaning liquid flow 180 through outlet 179 and into conduit section 181. The aerated cleaning liquid flow 180 can either be dispensed into washing chamber 108 or directed to a foam generating or foaming member 184 where it is received at inlet port 188. Foaming member 184 provides additional foaming action to the aerated cleaning liquid flow 180 through interaction a diffusion medium 194 contained in housing 186. The foamed cleaning liquid flow 116 can then be dispensed through outlet 190 of foaming member 184 and is directed to washing chamber 108 via conduit section 196 for use during the wash cycle.

In accordance with the nozzle embodiment of foaming device 122, the triggering of a wash cycle by controller 104 of washing machine 102 causes controller 146 of system 100 to drive the cleaning liquid flow 124 into inlet 202 and through throat 204. In response to the cleaning liquid flow 124, air flow 126 enters radial ports 212 and is combined with cleaning liquid flow 124 to form aerated cleaning liquid in mixing chamber 214. Finally, the aerated cleaning liquid or foamed cleaning liquid 116 is dispensed through nozzle tip 210 and into washing chamber 108.

Cleaning liquid 130 is preferably a mixture of a primary cleaning liquid component and a detergent or cleaning agent. The supply of cleaning liquid 130 can be stored in a container of washing machine 102 and fed to cleaning liquid flow control device 134 through conduit 132, as shown in FIG. 1. The primary cleaning liquid component is preferably water that is received from water supply 106 or from another source. The cleaning agent preferably includes an anionic surfactant, a nonionic surfactant, a cationic surfactant, or a combination thereof. A particularly preferred surfactant is DeTeric CP-Na-38 manufactured by DeForest Enterprises, Inc., of Boca Raton, Fla. A particularly preferred surfactant concentration of the cleaning liquid is approximately 0.1% of the primary cleaning liquid component. Alternative cleaning liquids may include one or more surfactants, builders, solvents, or other components.

Figure 5:
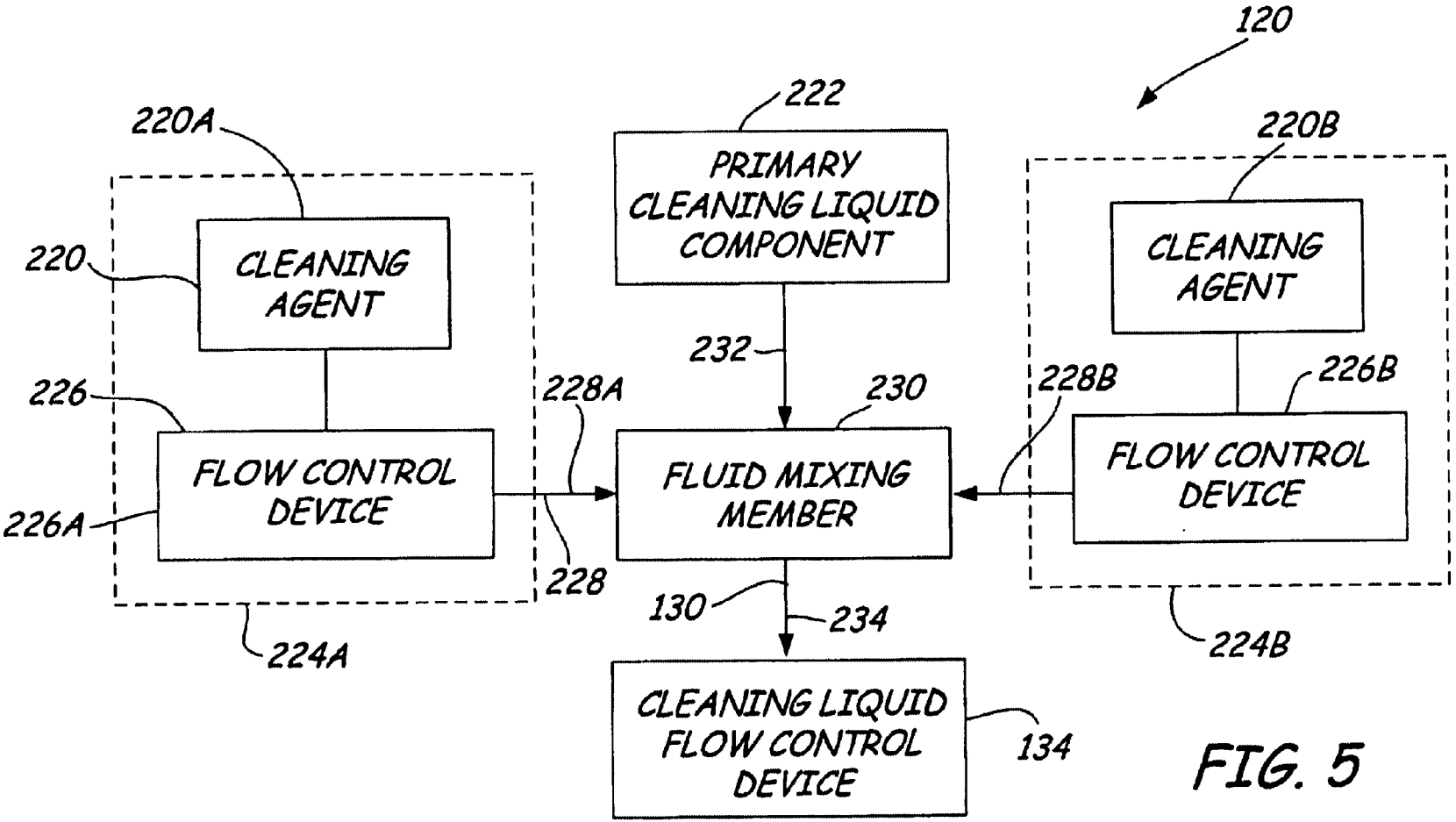
FIG. 5 is a schematic diagram of a system for dispensing one or more supplies of cleaning liquid in accordance with various embodiments of the invention.

In accordance with an alternative embodiment, the supply of cleaning liquid 130 is generated as a combination of separate supplies of cleaning agent 220 and primary cleaning liquid component 222, as illustrated in the schematic diagram of FIG. 5. Cleaning agent supply 200 is preferably in concentrated form and is a component of a chemical dispenser 224. Chemical dispenser 224 also includes a cleaning agent flow control device 226, which is fluidically coupled to supply 220 and provides a flow 228 of cleaning agent at a predetermined volume flow rate, preferably 0.1% of the primary cleaning liquid component to a fluid mixing member 230. As mentioned above, the supply 222 of primary cleaning liquid component is preferably provided from water supply 106 (FIG. 1), but could be provided by another source. Fluid mixing member 230 combines the cleaning agent flow 228 from flow control device 226 and a flow of primary cleaning liquid component 232 from supply 222 to form the cleaning liquid supply 130 in the form of a cleaning liquid flow 234, which is provided to cleaning liquid flow control device 134.

Figure 6:
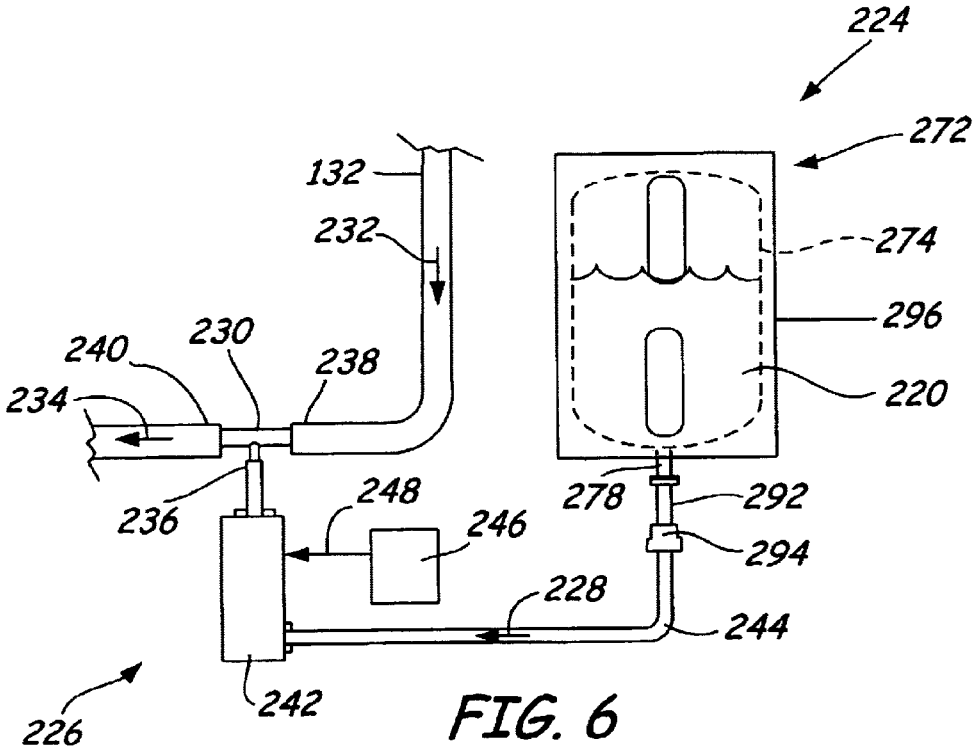
FIGS. 6–8 are schematic diagrams of chemical dispensers in accordance with various embodiments of the invention.
Figure 7:
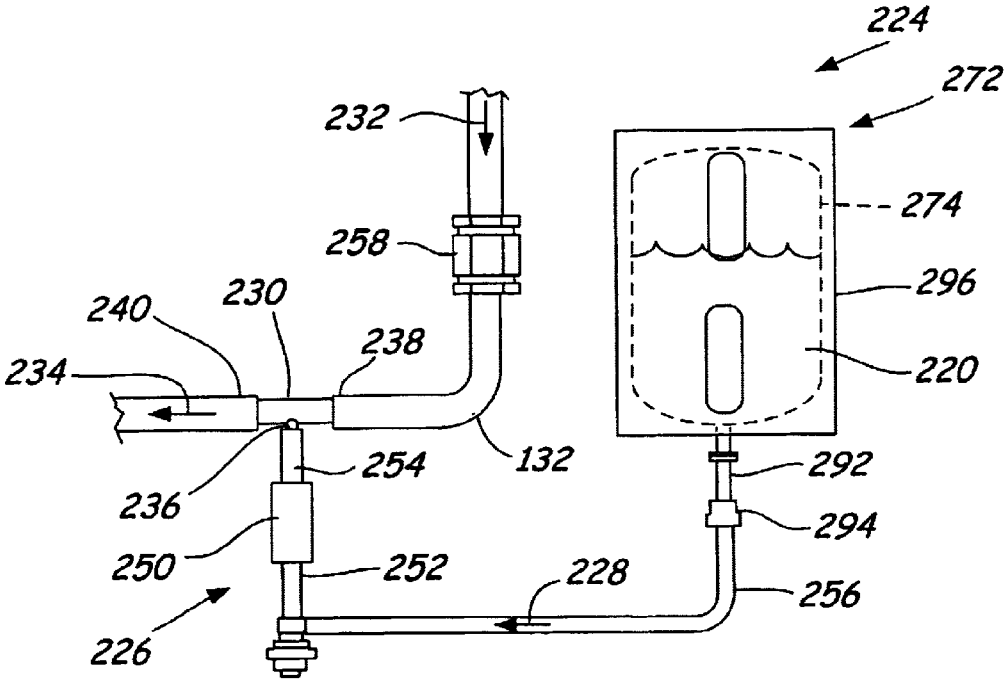
Figure 8:
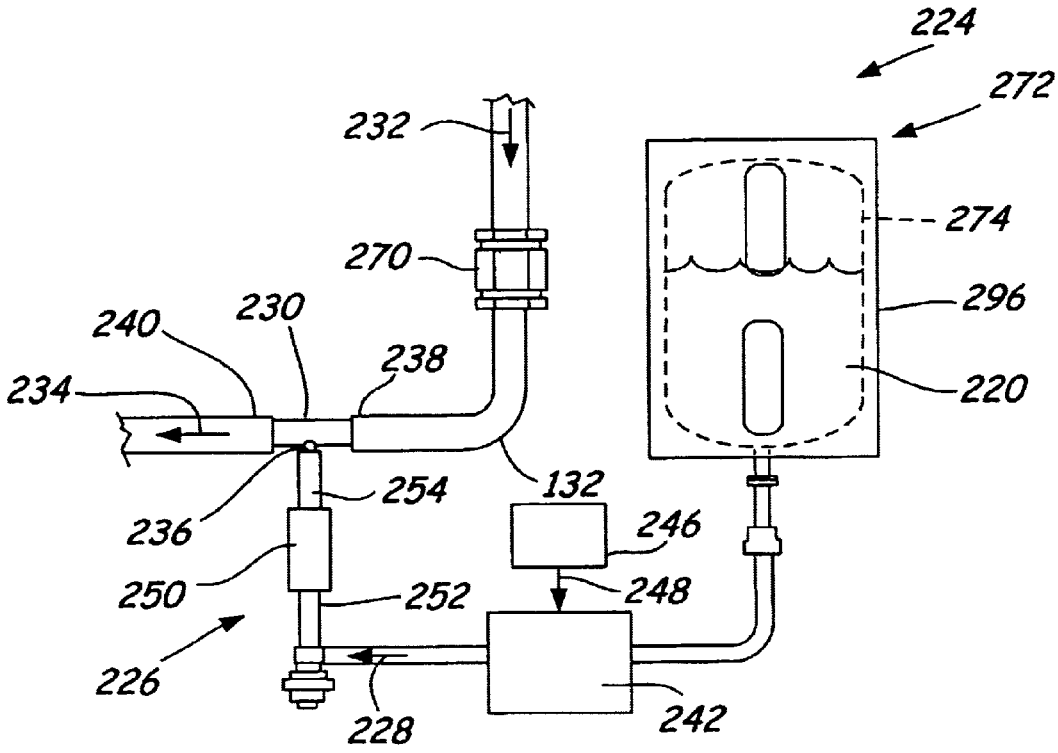

FIGS. 6–8 illustrate various embodiments of chemical dispenser 224 that can be used to inject cleaning agent flow 228 into flow 232 of primary cleaning liquid component to form the supply of cleaning liquid 130 for foamed cleaning liquid dispensing system 100 in accordance with various embodiments of the invention. Fluid mixing member 230 can be positioned either upstream or downstream of cleaning liquid flow control device 134, such as pump 140 shown in FIG. 2. It should be understood that the cleaning liquid supply 130 depicted in FIG. 2 could comprise only the primary cleaning liquid component where chemical dispenser 224 injects the cleaning agent flow 228 either upstream or downstream of cleaning liquid flow control device 134. Cleaning liquid flow control device 134 still substantially controls the flow rate of cleaning liquid flow 124 since the volume flow rate of cleaning agent flow 228 is small in comparison to the flow 232 of the primary cleaning liquid component.

Fluid mixing member 230 can be a T-coupling having inlets 236 and 238 that respectively receive the flows 228 and 232 of cleaning agent and primary cleaning liquid component, as shown in FIG. 6. The flow of cleaning liquid 124 is then provided at an outlet 240. Other types of fluid mixing components can be used as well to perform the function of fluid mixing member 230.

One embodiment of flow control device 226 includes a pump 242 that receives cleaning agent from cleaning agent supply 220 and drives the flow 228 of cleaning agent through conduit 244 to fluid mixing member 230 as shown in FIG. 6. The cleaning agent flow 228 is preferably generated substantially independently of the volume of cleaning agent in supply 220. A check valve (not shown) can be installed in line with conduit section 132 upstream of fluid mixing member 230 to prevent the back flow of cleaning agent therethrough. Pump 242 is preferably a solenoid pump, such as pump number ET200BRHP sold through Farmington Engineering of Madison, Conn., and manufactured by CEME. Another suitable pump is the SV 653 metering pump manufactured by Valcor Scientific. Other types of pumps can also be used for pump 230.

A controller 246 controls the operations of pump 242 through a control signal 248. Controller 246 can be incorporated into washing machine controller 104 (FIG. 1) or controller 146 (FIG. 2). An example of a suitable controller is part number QRS2211C (either 24 V or 36 V) sold by Infitec Inc. of Syracuse, N.Y. In accordance with one embodiment, signal 248 is a pulsed signal that provides power relative to ground (not shown.) and controls the duration over which pump 242 drives the flow 228 of cleaning agent through conduit section 244. For example, control signal 248 can turn pump 242 on for 0.1 seconds and off for 2.75 seconds to produce the desired low volume output flow 228 of cleaning agent.

In accordance with another embodiment of the invention, flow control device 226 includes a flow restriction member 250 having an upstream high pressure inlet 252 and a low pressure outlet 254, as shown in FIG. 7. Inlet 252 of flow restriction member 250 is fluidically coupled to supply of cleaning agent 220 through conduit section 256. Outlet 254 is fluidically coupled to inlet 236 of fluid mixing member 230. Fluid mixing member 230 is positioned upstream of cleaning liquid flow control device 134 and receives the flow of primary cleaning liquid 232 at inlet 238. A vacuum generating component 258, such as the metering orifice or orifice plate shown in FIG. 3, in combination with pump 140 (FIG. 2), can be provided in line with the flow of primary cleaning liquid component 232 to produce a low pressure region, preferably at approximately −1.0 psi, adjacent outlet 254 of flow restriction member 250. This vacuum produces a pressure gradient from the inlet 252 to the outlet 254 of flow restriction member 250 that results in a substantially constant flow 228 of cleaning agent through flow restriction member 250.

Figure 9:
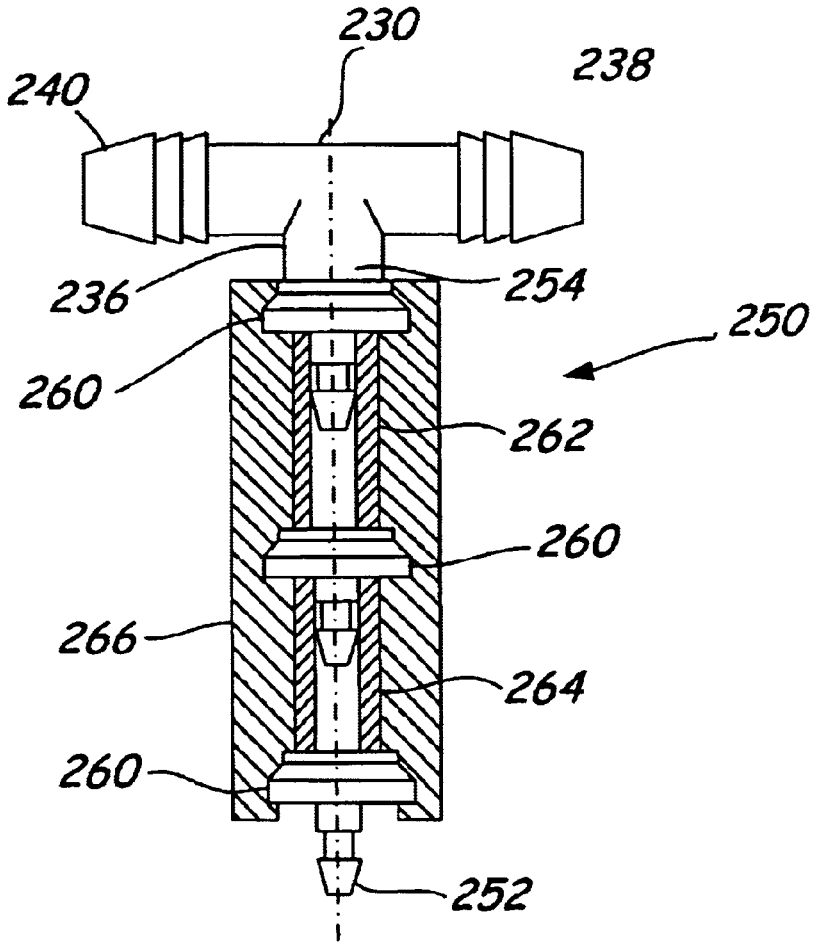
FIG. 9 is a cross-sectional view of a flow restriction member in accordance with an embodiment of the invention.

One embodiment of flow restriction member 250 includes a labyrinthine fluid flow path to provide the desired flow restriction. The labyrinthine path is preferably formed by one or more drip irrigators 260, such as those shown in FIG. 9. One such preferred drip irrigator 260 that can be used to form flow restriction member 250 is described in U.S. Pat. No. 5,031,837 and available as part no. R108C manufactured by Raindrip of Woodland Hills, Calif. Preferably three drip irrigators 260 are coupled together with tubing sections 262 and 264. A surround 266 covers drip irrigators 260 and tubing sections 262 and 264. Outlet 254 of flow restriction member 250 couples to inlet 236 of fluid mixing member 230 or to a section of tubing (not shown) that is coupled to inlet 236 of fluid mixing member 230. Inlet 252 of flow restriction member 250 is coupled to conduit section 256 (FIG. 7) for fluid communication with supply 220 of cleaning agent. Other suitable drip irrigators or similar flow restriction devices can also be used to form the desired labyrinthine path of this embodiment of flow restriction member 250.

In accordance with another embodiment of the invention, cleaning agent flow control device 226 of chemical dispenser 224 includes both the pump 242 and flow restriction member 250, as shown in FIG. 8. Pump 242 and flow restriction member 250 are placed in line with the supply of cleaning agent 220 and fluid mixing member 230. Pump 242 drives the flow of cleaning agent 228 through flow restriction member 250 in response to a control signal 248 from controller 246. A check valve 270 can be placed in line with flow 232 to prevent back flow to the primary cleaning liquid supply 222. Thus, pump 242 generates the desired pressure at inlet 252 of flow restriction member 250 that is higher than that at outlet 254 or at fluid mixing member 230 to drive the cleaning agent flow 228 therethrough at a substantially constant flow rate.

Foamed cleaning liquid dispensing system 100 can also be configured to use multiple chemical dispensers 224, as illustrated in FIG. 5, each of which is configured to dispense a respective cleaning agent or chemical for mixing with a flow of primary cleaning liquid component to form the desired cleaning liquid. Thus, for example, two cleaning agent dispensers 224A and 224B can be provided to respectfully dispense flows 228A and 228B of cleaning agents 220A and 220B using flow control devices 226A and 226B. The flows 228A and 228B are provided to fluid mixing member 230 for mixing with flow 232 of the primary cleaning liquid component. Additional chemical dispensers 224 adapted to dispense other cleaning agents or chemicals can also be added. This arrangement allows foamed cleaning liquid dispensing system 100 to dispense a different type of cleaning agent or other chemical as desired for the particular washing operation being performed by washing machine 102. For example, cleaning agent 220A can be a detergent for use during a wash cycle and cleaning agent 220B can be a fabric softener for use during a rinse cycle. In accordance with this embodiment, fluid mixing member 230 can be configured to selectively mix one or more of the cleaning agents with output flow 232 of the primary cleaning liquid component. Fluid mixing member 230 can include a single multi-way valve or other suitable component to accomplish selective mixing of a flow of cleaning agent 228 and the flow 232 of primary cleaning liquid component to form the desired cleaning liquid flow 234.

Figure 10:
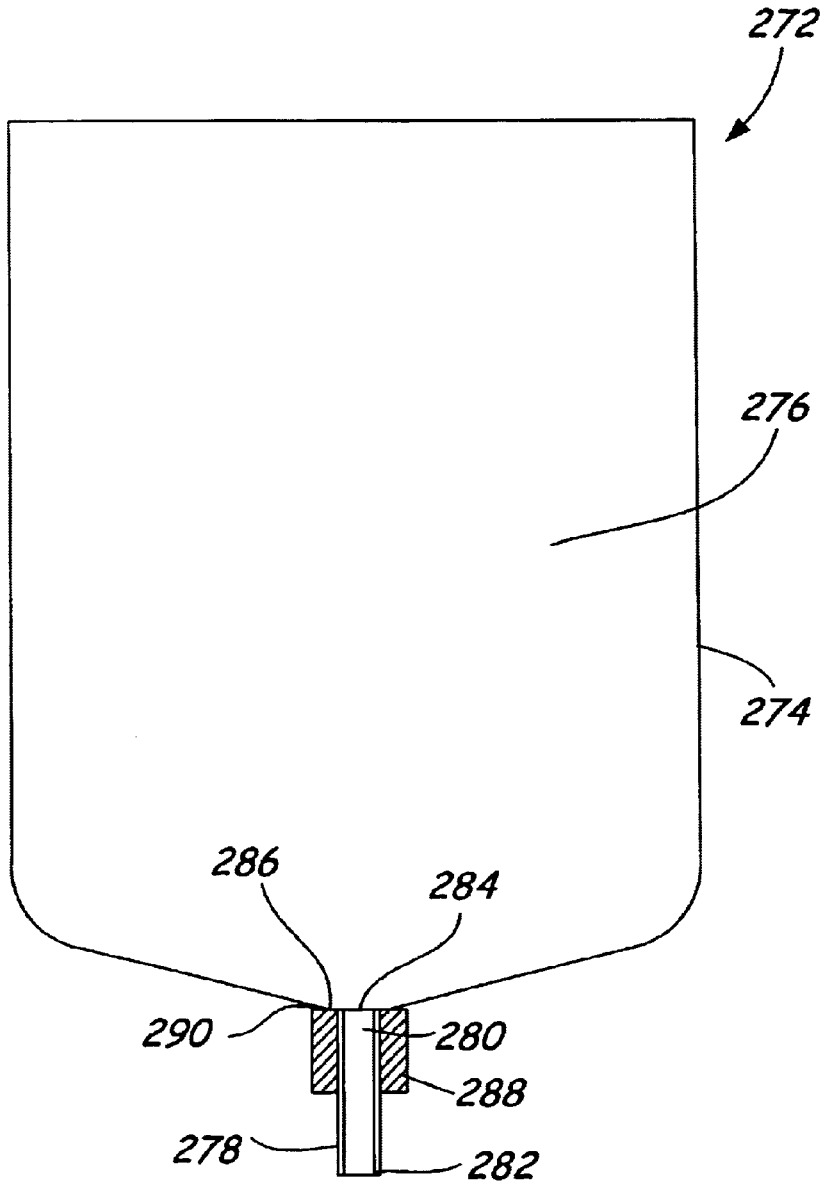
FIG. 10 is a simplified cross-sectional view of a cleaner cartridge in accordance with an embodiment of the invention.

Cleaning agent supply 220 is preferably contained in a disposable container or cleaner cartridge. In accordance with one embodiment, cleaner cartridge 272 generally includes a container 274 having an interior cavity 276 and conduit 278, as shown in FIG. 10. Conduit 278 includes a first end 280 that is fluidically coupled to flow control device 226 of cleaning agent dispenser 224. Container 274 is preferably a collapsible bag that is completely sealed except where connected to conduit 278. Thus, container 274 shrinks as the cleaning agent stored therein is depleted. In accordance with this embodiment, container 274 can be formed of vinyl or other suitable material. Alternatively container 274 can take the form of a rigid container, such as a box, that includes a vent for replacing dispensed cleaning agent with air. Container 274 can be transparent or translucent to allow the cleaning agent contained therein to be viewed. Alternatively, container 274 can be formed of a material that prevents the exposure of the cleaning agent contained therein from light.

First end 280 of conduit 278 is preferably attached to container 274 such that it is flush with the inside of outlet 284. A seal 286 is formed between first end 280 and container 274 at outlet 284 to prevent cleaning agent from escaping at that junction. In accordance with one embodiment, seal 286 includes an annular neck 288 surrounding first end 280 and adjoining container 274. A weld 290 can be formed between annular neck 288 and first end 280 and container 274 to further seal the junction. Other methods for sealing the junction of first end 280 and container 274 can also be used.

Conduit 278 can also include a flow control member 292, such as that depicted in FIG. 6, mounted to second end 282 to prevent the flow of cleaning agent therethrough when disconnected from flow control device 226. Flow control member 292 preferably includes a connector (quick-disconnect coupling) that includes a shut-off valve that is actuated when disconnected to seal container 274 and prevent the outflow of cleaning agent therefrom. A cooperating connector 294 is preferably attached to a section of conduit 244 and cooperates with connector/flow control member 292 to facilitate the quick-connection of cleaner cartridge 272 to cleaning agent flow control device 226. One suitable arrangement for connector/flow control member 292 and the cooperating connector 294 are coupling insert PLCD2200612 and coupling body PLCD1700412 manufactured by Colder Products Company of St. Paul, Minn. Other types of flow-control members 292 can also be installed at second end 282 of conduit 278 to seal interior cavity 276 of container 274 such as a valve, a metering device, a clamp, a membrane, a cap, or other suitable control member.

In accordance with one embodiment of the invention, cleaner cartridge 272 includes a housing 296, shown in FIG. 6, that encloses container 274. Housing 296 provides protection and support to container 274, which is particularly useful when container 274 is in the form of a collapsible bag. Housing 296 is preferably made from a single piece of rigid or semi-rigid material, such as plastic, cardboard and/or metal that is folded to form a box in which container 274 is contained. In accordance with a preferred embodiment, housing 296 is formed of corrugated plastic or cardboard.

In operation, cleaner cartridge 272 is provided and a supply of cleaning agent is stored in interior cavity 276 of container 274. Next, second end 282 of conduit 278 is coupled to cleaning agent flow control device 226 and cartridge 272 is installed in a cartridge receiver mounted to washing machine 102. Cleaning agent flow control device 226 can then receive the supply of cleaning agent through conduit 278 and provide a controlled output flow 228 of cleaning agent, as discussed above.

Although the present invention has been described with reference to preferred embodiments, workers skilled in the art will recognize that changes may be made in form and detail without departing from the spirit and scope of the invention. For example, the foamed cleaning liquid dispensing system of the present invention may be used with other washing machines, such as dish washing machines, car washing machines, and other types of washing machines in which improved cleaning efficiency, lower energy consumption, and reduced waste is desired. Furthermore, it should be understood that the particular configuration of the various components of the present invention can be rearranged and still provide the desired function while remaining within the scope of the present invention.

What is claimed is:

1. A foamed cleaning liquid dispensing system for use with a washing machine having a washing chamber in which soiled articles are cleaned, the system comprising:

a cleaning liquid dispenser including a supply of cleaning liquid, conduit in fluid communication with the supply of cleaning liquid, and a pump in line with the conduit and driving an output flow of cleaning liquid therethrough; and a foaming device receiving the output flow of cleaning liquid and having an input flow of air, a mixing member combining the flows of air and cleaning liquid to thereby form an output flow of foamed cleaning liquid that is directed into the washing chamber.

2. The system of claim 1, wherein the cleaning liquid flow control device includes a flow restriction member generating a pressure drop in the conduit thereby restricting a flow rate of the output flow of cleaning liquid.

3. The system of claim 2, wherein the flow restriction member includes an orifice plate.

4. The system of claim 1, wherein the cleaning liquid flow control device includes a controller having a control signal that is electrically coupled to the pump, the pump driving the output flow of cleaning liquid in response to the control signal.

5. The system of claim 4, wherein the pump is powered by the control signal.

6. The system of claim 1, including:

a supply of cleaning agent;

a flow of primary cleaning liquid component;

a cleaning agent flow control device fluidically coupled to the supply of cleaning agent and having an output flow of cleaning agent; and a fluid mixing member combining the flows of cleaning agent and primary cleaning liquid component to form the supply of cleaning liquid.

7. The system of claim 6, wherein the cleaning agent flow control device includes a pump driving the output flow of cleaning agent.

8. The system of claim 7, including a controller having a control signal that is electrically coupled to the pump, wherein the pump drives the output flow of cleaning agent in response to the control signal.

9. The system of claim 7, wherein the flow control device includes a flow restriction member having an upstream high pressure inlet and a downstream low pressure outlet.

10. The system of claim 9, wherein the flow restriction member includes a labyrinthine fluid flow path through which the output flow cleaning agent travels.

11. The system of claim 6, wherein the cleaning agent includes an anionic surfactant, a nonionic surfactant, and/or a cationic surfactant.

12. The system of claim 6, wherein the cleaning liquid dispenser includes a cleaner cartridge comprising:

a container having an interior cavity in which the supply of cleaning agent is contained; and conduit having a first end fluidically coupled to the interior cavity and a second end connectable to an inlet of the cleaning agent flow control device.

13. The system of claim 1, wherein the cleaning liquid dispenser includes:

a plurality of cleaning agent supplies;

a flow of primary cleaning liquid component;

a plurality of cleaning agent flow control devices, each fluidically coupled to one of the cleaning agent supplies and having an output flow of the corresponding cleaning agent; and a fluid mixing member selectively combining at least one of the output flows of cleaning agent with the flow of primary cleaning liquid component to form the supply of cleaning liquid.

14. The system of claim 1, wherein the foaming device includes a foam generating nozzle.

15. The system of claim 1, wherein the foaming device includes:

an air pump generating the input flow of air;

a mixing element combining the flows of air and cleaning liquid to form an output flow of aerated cleaning liquid; and a foam generating member including a housing having an inlet port receiving the output flow of aerated cleaning liquid, an outlet port fluidically coupled to the washing chamber, and a diffusion medium contained in the housing, wherein foamed cleaning liquid is generated within the housing through interaction between the aerated cleaning liquid and the diffusion medium and is dispensed through the outlet port.

16. A washing machine comprising:

a supply of cleaning agent;

a flow of primary cleaning liquid component;

a cleaning agent flow control device fluidically coupled to the supply of cleaning agent and having an output flow of cleaning agent;

a fluid mixing member combining the flows of cleaning agent and primary cleaning liquid component to form a supply of cleaning liquid;

conduit in fluid communication with the supply of cleaning liquid;

a cleaning liquid flow control device in line with the conduit and having an output flow of cleaning liquid;

a foaming device receiving the output flow of cleaning liquid and having an input flow of air, a mixing member combining the air with the cleaning liquid, and an output flow of foamed cleaning liquid;

a washing chamber receiving the output flow of foamed cleaning liquid; and a washing device contained in the washing chamber and adapted to agitate laundry articles within the washing chamber.

* * * * *